United States Patent [19]

Fujita

[11] Patent Number: 5,069,006

[45] **Date of Patent: * Dec. 3, 1991**

[54] ELECTRICALLY-OPERATED FOLDING STAGE SYSTEM

[76] Inventor: Kazuo Fujita, No. 1, Hagiyamadai 1-Chome, Seto-shi, Aichi-ken, Japan

[ * ] Notice: The portion of the term of this patent subsequent to Oct. 10, 2006 has been disclaimed.

[21] Appl. No.: 475,858

[22] Filed: Feb. 6, 1990

[30] Foreign Application Priority Data

Apr. 13, 1989 [JP] Japan ..... 1-94238

[51] Int. Cl.[5] ..... E04H 3/26

[52] U.S. Cl. ..... 52/7; 52/10; 52/64; 182/223

[58] Field of Search ..... 52/7–10, 52/71, 64, 69; 272/9, 12; 182/223

[56] References Cited

U.S. PATENT DOCUMENTS

| | | | |
|---|---|---|---|
| 2,978,754 | 4/1961 | Wilson | 52/7 |
| 4,872,295 | 10/1989 | Fujita | 52/7 |
| 4,917,217 | 4/1990 | Rogers et al. | 52/7 X |
| 4,939,875 | 7/1990 | Fujita | 52/7 |
| 4,984,398 | 1/1991 | Fujita | 52/7 |

FOREIGN PATENT DOCUMENTS

| | | | |
|---|---|---|---|
| 753000 | 2/1967 | Canada | 52/7 |
| 271402 | 6/1988 | European Pat. Off. | 52/64 |
| 4917620 | 8/1952 | Japan . | |
| 52999 | 12/1954 | Japan . | |
| 53466 | 5/1955 | Japan . | |
| 59100829 | 1/1961 | Japan . | |
| 50163072 | 7/1978 | Japan . | |
| 54102659 | 3/1981 | Japan . | |
| 58118955 | 1/1985 | Japan . | |
| 58138225 | 3/1985 | Japan . | |
| 5282315 | 7/1985 | Japan . | |
| 5655085 | 11/1986 | Japan . | |
| 60126289 | 2/1987 | Japan . | |
| 6172248 | 11/1987 | Japan . | |
| 62-139568 | 12/1988 | Japan . | |
| 62262466 | 4/1989 | Japan . | |
| 24458 | 1/1990 | Japan | 52/7 |
| 61267 | 3/1990 | Japan | 52/7 |

*Primary Examiner*—Richard E. Chilcot, Jr.
*Assistant Examiner*—Deborah McGann Ripley
*Attorney, Agent, or Firm*—Fred Philpitt

[57] ABSTRACT

An electrically-operated folding stage system which embodies the invention in one preferred form comprises (a) a stage body with (i) a platform, (ii) plural rows of upright legs pivotally connected to a bottom of the platform, and (iii) plural connecting members each located along a line connecting lower portions of the legs of one row for connecting the legs to one another, (b) wheels connected to bottoms of foremost ones of the legs to facilitate movements of the stage body on a floor, (c) plural geared motors fixed to the bottom of the platform and each capable of being rotated in either of opposed directions to move the stage body between a horizontal position on the floor and a vertical position immediately adjacent to a wall, each of the geared motors having an output shaft, (d) swing arms each having one end fixed to the output shaft of one of the geared motors, and (e) support means each provided in conjunction with one of the swing arms and located on a given position predetermined in relation to a lower portion of the wall for pivotally supporting an opposed end of the swing arm. The swing arm may comprise a pair of integrally formed tubes and a pair of rods slidably disposed in the respective tubes.

14 Claims, 5 Drawing Sheets

ELECTRICALLY-OPERATED FOLDING STAGE SYSTEM

FIELD OF THE INVENTION

This invention relates to electrically-operated folding stage systems.

BACKGROUND OF THE INVENTION

A typical folding stage system of the prior art is proposed in Japanese Application for Registration of Utility Model No. 52-82315 (published under No. 60-25482). The prior folding stage system has a guide post to be fixed to a wall or the like, and a balancer mechanism supporting the rear portion of the stage body for vertical movement. The prior folding stage system also has, on its front portion, wheels to enable the stage body to be moved on a floor. The stage body of the system can be "folded" or stored from a horizontal position on the floor to a vertical position adjacent to the post. Legs are pivotally connected to the bottom of a platform so that the legs make right angles with the platform when supporting the platform on the floor, but change their angles to the platform as the legs are raised away from the floor when the stage body is moved to the vertical position, and become parallel to the platform when the platform is moved to a vertical position.

The inventor hereof proposed a folding stage system similar to the foregoing one in Japanese Application for Registration of Utility Model No. 59-100829 (published under No. 61-16200).

However, with the help of the balancer mechanism, either of the prior folding stage systems must be manually folded or unfolded. Also, the presence of the guide post and the balancer mechanism provided therein relatively complicates the construction of the whole system.

SUMMARY OF THE INVENTION

Accordingly, it is an object of the invention to provide a folding stage system which is operated electrically.

Another object of the invention is to provide a folding stage system having no guide post and, hence, having a relatively simple construction.

An electrically-operated folding stage system which embodies the invention in the most preferred form comprises (a) a stage body with a platform, with plural rows of upright legs pivotally connected to a bottom of the platform and with plural connecting members each located along a line connecting lower portions of the legs of one row for connecting the legs to one another, (b) wheels connected to bottoms of foremost ones of the legs to facilitate movements of the stage body on a floor, (c) plural geared motors fixed to the bottom of the platform and each capable of being rotated in either of clockwise and counterclockwise directions to move the stage body between a horizontal position on the floor and a vertical position immediately adjacent to a wall and each having an output shaft, (d) swing arms each having one end fixed to the output shaft of one of the geared motors, and (e) support means each provided in conjunction with one of the swing arms and located on a given position predetermined in relation to a lower portion of the wall for pivotally supporting an opposed end of the swing arm. The swing arm may comprise a pair of integrally formed tubes and a pair of rods slidably disposed in the respective tubes.

BRIEF DESCRIPTION OF THE DRAWING

In FIGS. 5 and 6 a lower portion of the stage system is viewed from one side thereof and from the front thereof, respectively.

DETAILED DESCRIPTION OF PREFERRED EMBODIMENTS

First Embodiment

Figure 1:
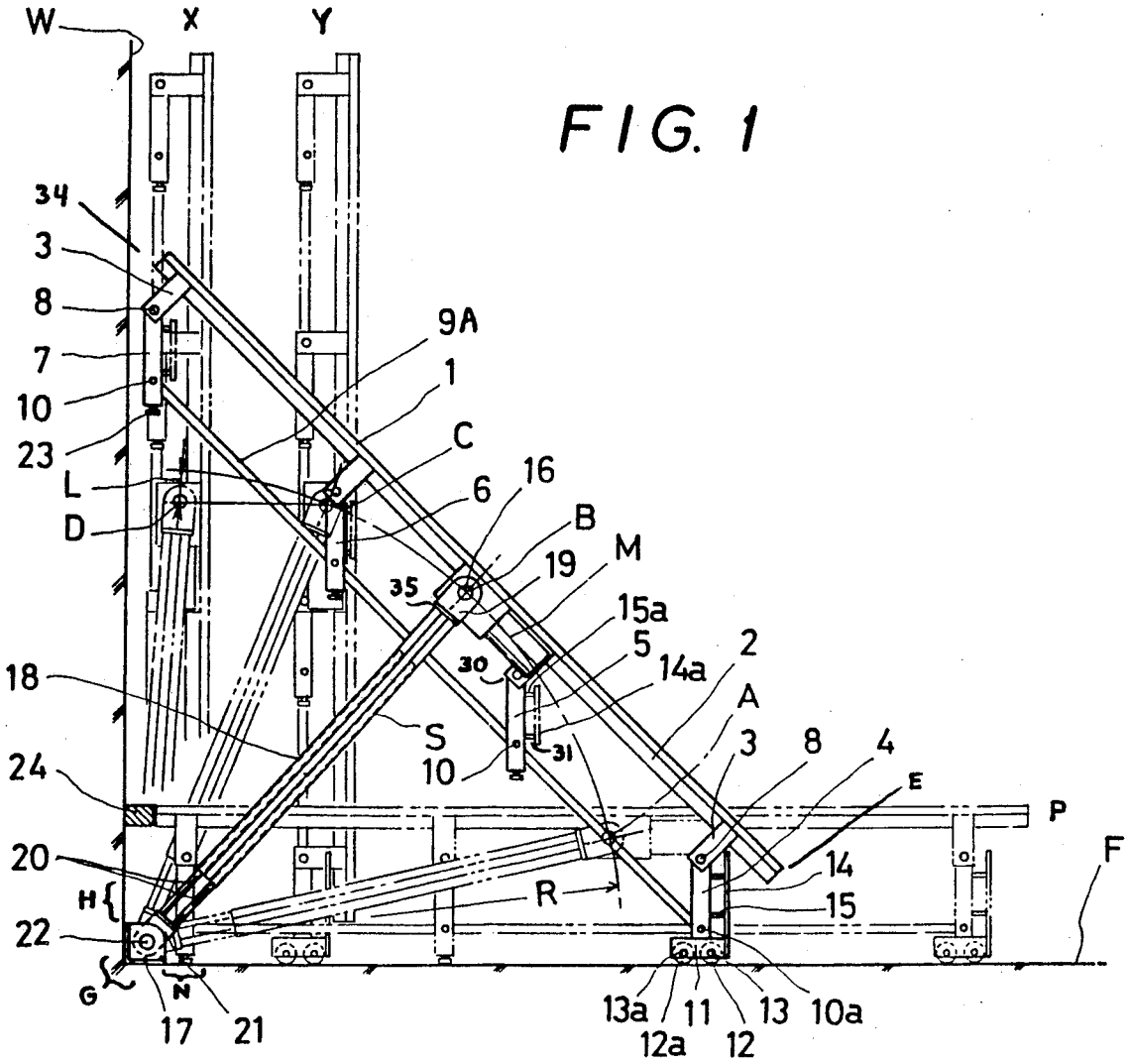
FIG. 1 is a side view of an electrically-operated folding stage system according to the invention.
Figure 2:
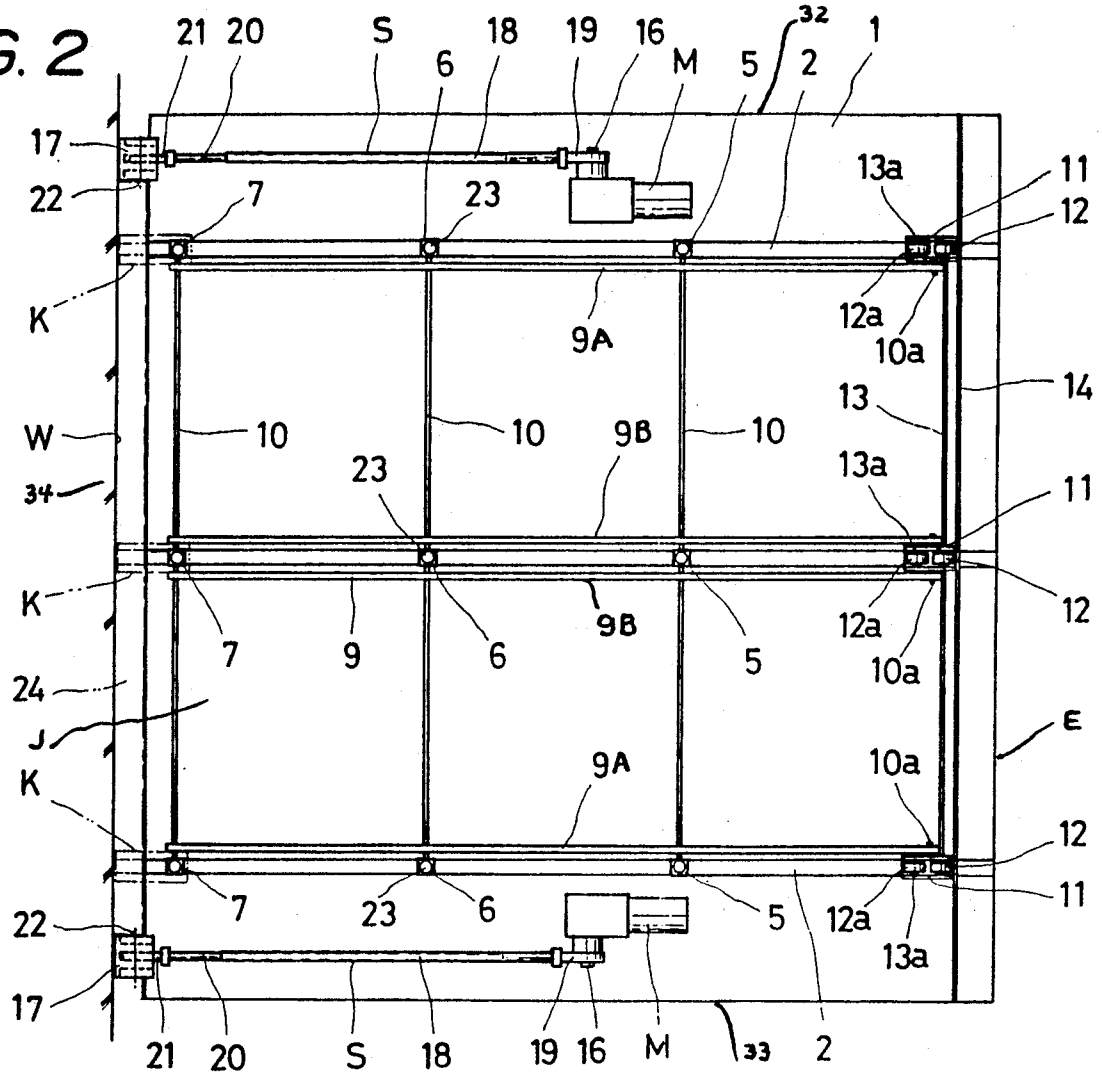
FIG. 2 is a bottom view of the system of FIG. 1.

A folding stage system which embodies the invention in one preferred form is illustrated in FIGS. 1 and 2. The folding stage system includes a platform 1 which provides a stage when the stage system is in the state of being unfolded to a horizontal position. Plural beams 2 are fixed to the bottom J (FIG. 2) of the platform 1. In the illustrated embodiment the beams 2 are three in number. The beams 2 extend from the front side, or the right side (FIG. 1) of the platform 1 to the rear side, or the left side thereof. A row of support members 3 are fixed to each beam 2. The support members 3 of each row are equally spaced apart from one another. Upright legs 4 to 7 are pivotally connected at upper ends 30 thereof to the lower ends of the respective support members 3 of each row by means of pins 8. Three rows of upright legs 4 to 7 are provided (FIG. 2). Each row of the upright legs 4 to 7 is along one of the beams 2 (FIG. 2) and comprises a foremost leg 4, middle legs 5 and 6, and a rearmost leg 7. In FIG. 1 only one of the three rows of the upright legs 4 to 7, namely, one of the outer rows thereof, is shown. Since in FIG. 2 the platform 1 is viewed from below, the foremost leg 4 of each row is hidden from view by wheels 12 and 12*a* which will be described later. An outer connecting member 9A connects lower portions 31 (FIG. 1) of the legs 4 to 7 of one of the outer rows. A pair of central connecting members 9B connect lower portions of the legs 4 to 7 of the central row. Another outer connecting member 9A is located along an imaginary line connecting lower portions of the legs 4 to 7 of the other outer row. Three long rods 10 are located at right angles to the connecting members 9. A first long rod 10 extends through the second legs 5 and the connecting members 9. A second long rod 10 extends through the third legs 6 and the connecting members 9. A third, or rearmost, long rod 10 extends through the fourth, or rearmost, legs 7 and the connecting members 9. The connecting members 9 are pivotally connected to the rods 10. In addition, a short pivotal pin 10*a* extends through the lower end of one of the outer foremost legs 4 and the foremost portion of the associated outer connecting member 9. Also, a short pivotal pin 10*a* extends through the lower end of the central foremost leg 4 and the foremost portions of the central connecting members 9. Also, a short pivotal pin 10*a* extends through the lower end of the other outer foremost leg 4 and the foremost portion of the associated outer connecting member 9. The connecting members 9 are capable of pivotal movement on the short pivotal pins 10*a*.

An enclosure 11 is fixed to the bottom of each foremost leg 4. A pair of lined-up wheels 12 and 12*a* are provided in the enclosure 11. The wheel 12*a* is supported on a short axle 13*a* which is provided in the enclosure 11. The wheel 12 is supported on a long axle 13 which extends in parallel with a front edge E of the platform 1 and on which the other wheels 12 associated with the other foremost legs 4 are also supported. The greater part of each wheel is covered with the enclosure 11. The wheels 12 and 12*a* facilitate the movement of the stage body. The "stage body" herein collectively means the platform 1 and the foregoing construction connected to the bottom of the platform.

A plate 14 is connected to the foremost legs 4 by means of connecting means 15 to keep the construction below the platform 1 from the sight of an audience. The plate 14 also serves to reinforce the connection of the foremost legs 4.

A pair of opposed geared motors M may be fixed on the bottom of the platform 1 with the foregoing framework structure between. More than two geared motors may be provided if the dimension between the sides of the platform is relatively long. Each geared motor may be rotated in either of clockwise and counterclockwise directions. Each geared motor M has an outwardly projecting output shaft 16. The output shaft 16 has a torque limiter (not shown) therein. The output shaft should preferably be located rearwardly of the straight line extending in parallel with the front edge E of the stage body and connecting one side 32 of the stage body, the center of gravity thereof and the other side 33 thereof. This arrangement facilitates the raising of the rearward end portion 34 (the left-hand end portion) of the stage body by a swing arm (which will be described later). As illustrated, swing arm supports 17 may be fixed to the corner G at which the floor F and a wall W meet. If desired, the swing arm supports 17 may be fixed to portions (such as indicated by the letter H of FIG. 1) of the wall W which is in lower levels than the platform 1 when the platform 1 is in a horizontal position P shown in phantom. Also, if desired, the swing arm supports 17 may be fixed to portions (such as indicated by the letter N of FIG. 1) of the floor F which are as near to the wall W as possible.

The letter S designates a swing arm. The swing arm S includes a pair of integrally formed tubes 18 and a pair of rods 20 slidably disposed in the respective tubes 18. The tubes 18 are fixed to the output shaft 16 of the geared motor M at 19. The lower ends of the rods 20 are connected by means of connecting means 21. The connecting means 21 is pivotally connected to the swing arm support 17 by a pin 22. The connecting means 21 consititutes a lower end of the swing arm. Short auxiliary legs 23 are fixed to the bottoms of all the legs other than the foremost legs 4. The auxiliary legs 23 have such heights that, when the auxiliary legs 23 are on the floor, the associated legs have the same heights from the floor as the foremost legs 4. Thus, when the stage system is in the state of being unfolded, the platform is in the horizontal position P on the floor.

If desired, the integrally formed tubes 18 may be replaced with a cylinder (not shown).

A ledge 24 is fixed to the wall W, and is flush with the platform 1 when the platform 1 is in the horizontal position P on the floor. The ledge 24 serves to fill the gap between the wall W and the platform 1 when the platform 1 is in the horizontal position on the floor.

Folding of the Stage System

When the stage system is to be folded from its horizontal position P on the floor of a gymnasium, a public hall or the like to a vertical position immediately adjacent to the wall W, the motors M are simultaneously operated to rotate their output shafts 16 clockwise (in FIG. 1) at a very low speed, e.g., at a reduction ratio of 1:24,000. Thus each swing arm S gradually raises the rear portion of the stage body as the swing arm S makes an arcing motion toward the wall W. Concomitantly the wheels 12 and 12*a* move toward the wall W. Also, the upright legs 4 to 7 change their angles to the platform from the right angles to acute angles.

When the stage body is in the horizontal position P on the floor, the output shaft 16 of each geared motor M is in a position indicated by the letter A. As the rear portion of the stage body is raised, the output shaft 16 makes an arcing motion as indicated by a curved line of FIG. 1. When the output shaft 16 passes a position B, the stage body is still in the process of moving to a vertical position.

When the output shaft 16 has reached a position C, the stage body is in a first vertical position Y as shown in phantom (in FIG. 1) which is a little distant from the wall W. When the stage body is in the first vertical position, the legs 4 to 7 are parallel with the platform 1.

While the output shaft 16 moves from the position A to the position C, the rods 20 do not change their positions relative to the tubes 18, i.e., do not come more deeply into the tubes nor project therefrom by greater amounts. Thus, while the output shaft 16 moves from the position A to the position C, the distance, or radius R, between the pivotal pin 22 and the output shaft 16 does not vary.

The motors M are still being operated. Thus, the swing arm S causes the stage body to move to the left (in FIG. 1). The stage body moves to the left on the floor without changing its vertical posture. When the stage body has reached a second vertical position X immediately adjacent to the wall W which is shown in phantom in FIG. 1, the motors M are stopped. When the stage body is in the second vertical position, the output shaft 16 is in a position indicated by the letter D. While the stage body is thus moved from the first vertical position Y to the second vertical position X, the rods 20 slide, relative to the tubes 18, toward the upper end 35 of the tubes 18 by an amount L equal to the radius R when the output shaft 16 was making the arcing motion from the position A from the position C minus the distance between the pivotal pin 22 and the output shaft 16 when the stage body is in the second vertical position X. Thus, while the stage body is moved from the first vertical position Y to the second vertical position X, the distance between the pivotal pin 22 and the output shaft 16 is reduced by the foregoing amount L.

While the stage system is thus folded, or stored, from the horizontal position P to the second vertical position X, the output shaft 16 is rotated for substantially 180 degrees.

Unfolding of the Stage System

When the stage system is to be unfolded from its second vertical position to a horizontal position, the motors M are simultaneously operated to rotate their output shafts 16 counterclockwise (in FIG. 1) at a very low speed, e.g., at a reduction ratio of 1:24,000. Thus the swing arm S starts to arc in a counterclockwise direction to cause the wheels 12 and 12*a* to move forward away from the wall W. The stage body comes to the foregoing first vertical position Y without changing its vertical posture. While the stage body comes to the first vertical position Y, the rods 20 slide relative to the tubes 18 so that the distance between the pivotal pin 22 and the output shaft 16 increases by the foregoing amount. After the stage body has reached the first vertical position Y, the rearward end portion 34 thereof starts to be lowered. The stage body is thus unfolded to the horizontal position on the floor. While the stage body is moved from the first vertical position X to the horizontal position, the distance between the pivotal pin 22 and the output shaft 16 does not vary. The legs 4 to 7 always maintain their upright positions.

While the stage system is thus unfolded from the second vertical position to the horizontal position, the output shaft 16 is rotated for substantially 180 degrees.

Second Embodiment

Figure 3:
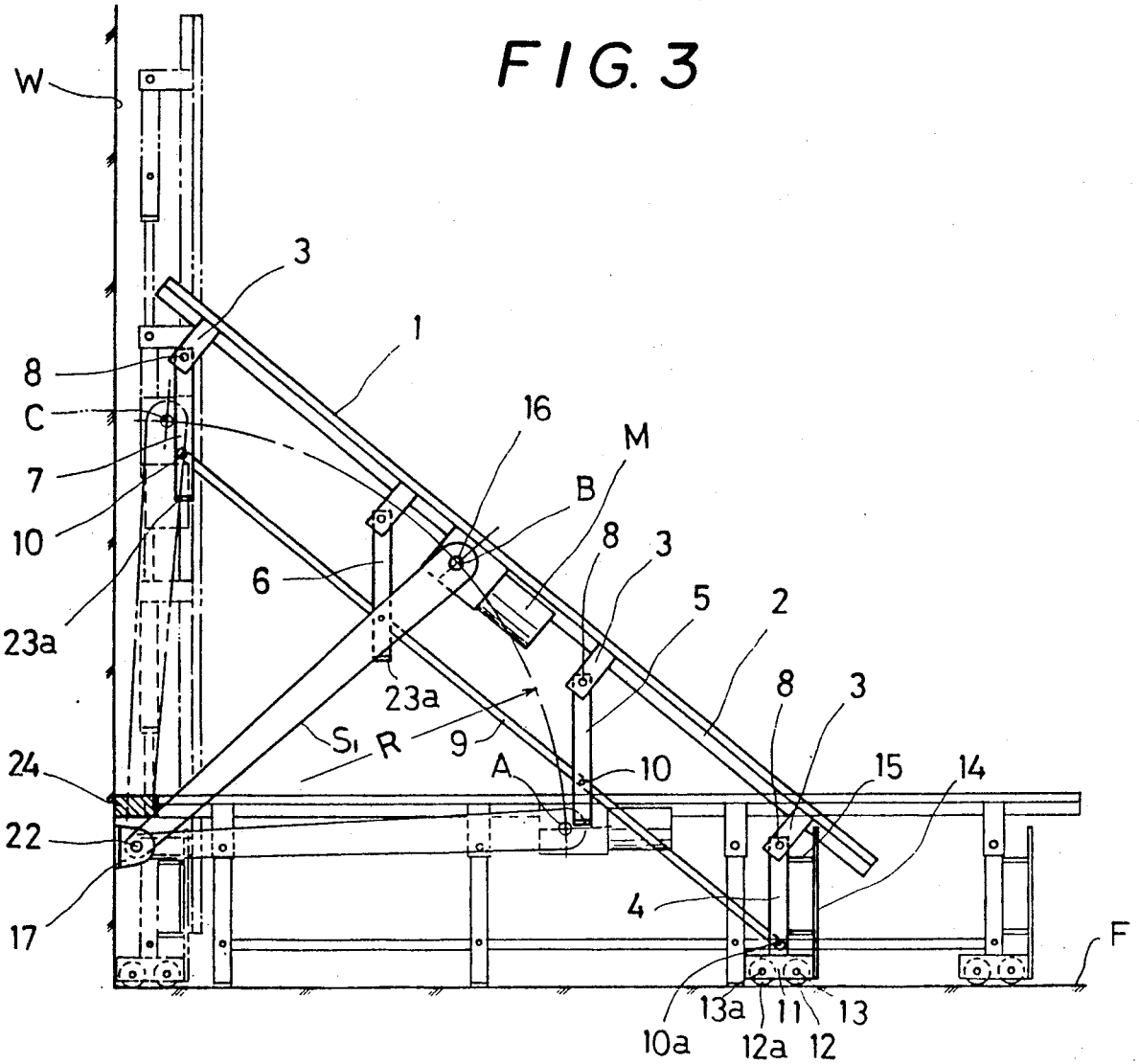
FIG. 3 is a side view of another electrically-operated folding stage system according to the invention.

FIG. 3 depicts a stage system which embodies the invention in another preferred form. The stage system of FIG. 3 differs from the stage system of FIG. 1 in that an inextensible swing arm $S_1$ is used instead of the extensible swing arm S. Unlike the swing arm S, the swing arm $S_1$ comprises a single continuous member, and is pivotally connected by a pin 22 to a support 17 fixed to a portion of a wall W which is slightly below a platform 1 when the platform 1 is in a horizontal position on a floor. The stage system of FIG. 3 also differs from the stage system of FIG. 1 in that pads 23*a* of hard rubber instead of the auxiliary legs 23 of FIG. 1 are fixed to the bottoms of all the upright legs other than the foremost ones. In the other respects the stage system of FIG. 3 has the same construction as that of FIG. 1. Parts equivalent to those of the stage system of FIG. 1 are indicated by the same numerals.

Third Embodiment

Figure 4:
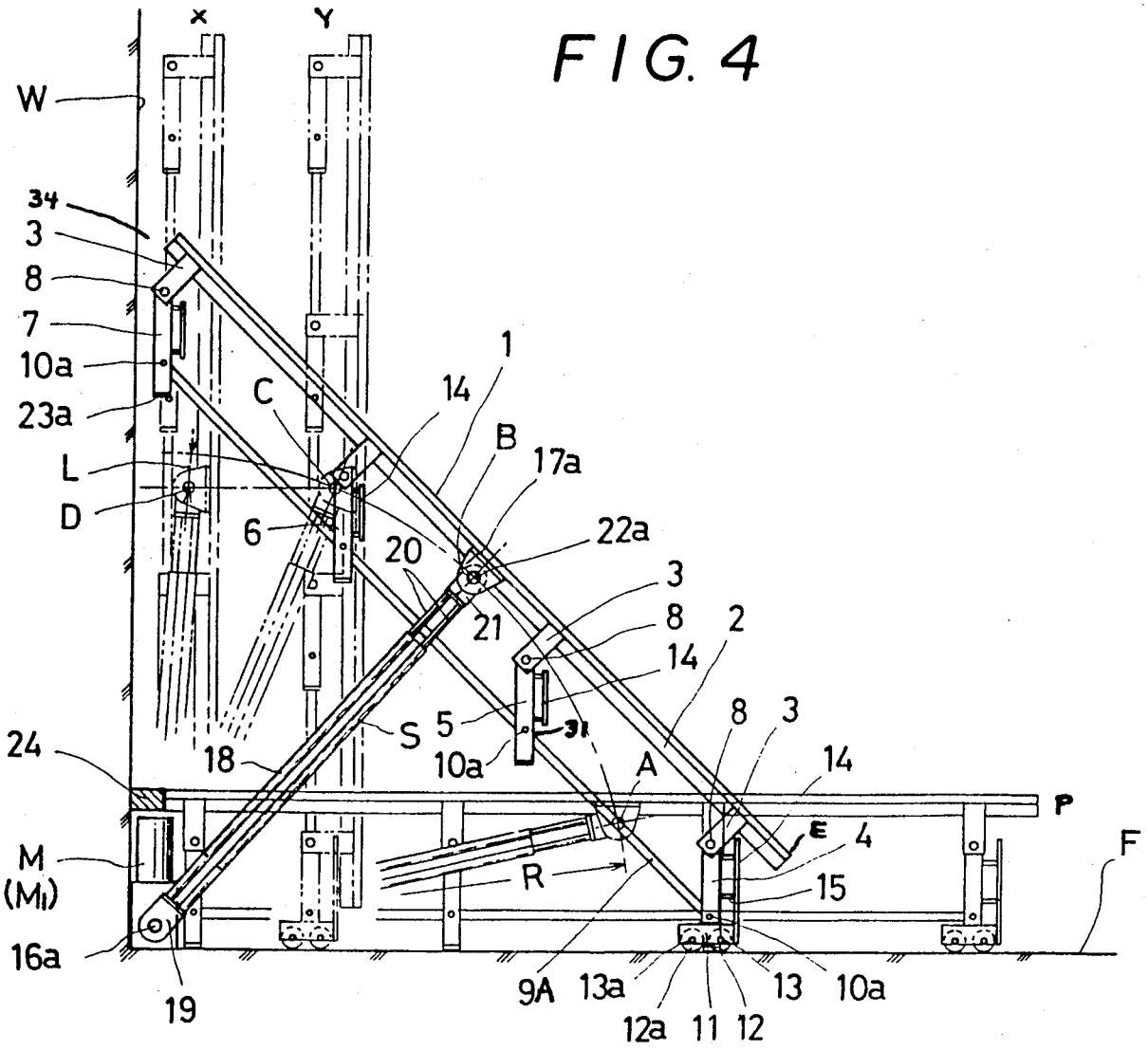
FIG. 4 is a side view of still another electrically-operated folding stage system according to the invention.

FIG. 4 depicts a stage system which embodies the invention in still another preferred form. The stage system of FIG. 4 differs from that of FIG. 1 in that the former has an operating mechanism which is arranged reversely to the latter. That is, with the stage system of FIG. 4, a pair of integrally formed tubes 18 are fixed at 19 to an output shaft 16*a* of a geared motor M which is secured to a corner at which a floor F and a wall W meet. And a pair of rods 20 slidably disposed in the respective tubes 18 are pivotally connected at 21 by a pin 22*a* to a support 17*a* fixed to the bottom of the platform. In the other respects the stage system of FIG. 4 has the same construction as that of FIG. 1. Parts equivalent to those of the stage system of FIG. 1 are indicated by the same numerals.

The support 17*a* should preferably be located such that the pin 22*a* connecting the rods 18 thereto is in a position which is further from the front edge E of the stage body than the straight line connecting one side of the stage body, the center of gravity thereof and the opposed side thereof. Such an arrangement facilitates the raising of the rearward end portion (the left-hand end portion) of the stage body by the swing arm S.

If desired, the geared motor of FIG. 4 may be located on a portion of the floor which is as near to the wall as possible.

Also, if desired, the geared motor of FIG. 4 may be replaced with other means for operating the stage body.

It is also possible to modify the stage system of FIG. 4 into a form similar to that of FIG. 3.

Variation of Wheels and Addition of Storing Means

Figure 6:
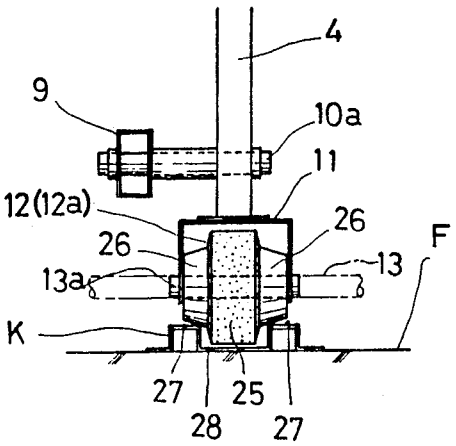
FIGS. 5 and 6 depict wheels which may be used instead of wheels of FIGS. 1 and 2, together with a storing means.
Figure 5:
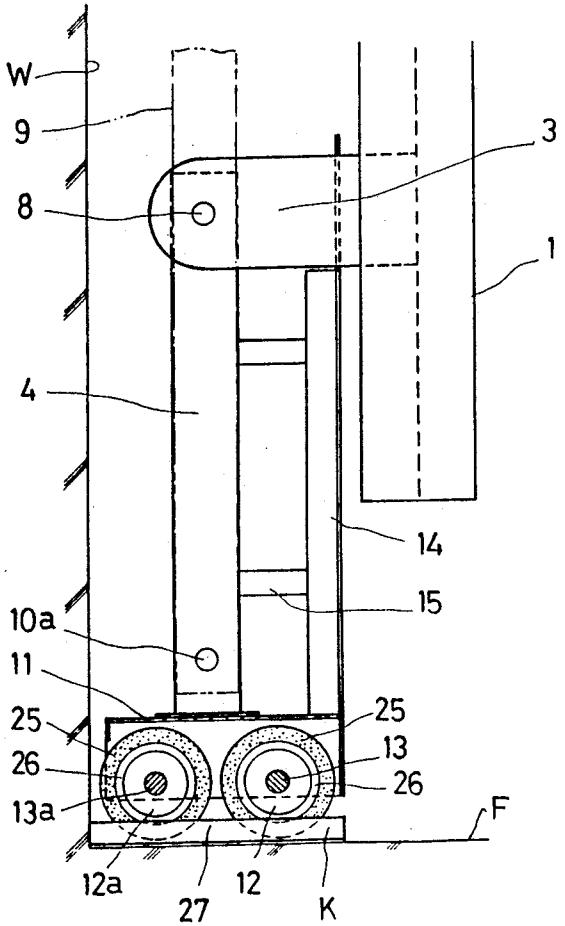

Wheels 12 and 12*a* of FIGS. 5 and 6 may be used instead of the wheels of FIG. 1.

FIG. 5 is a side view of the wheels 12 and 12*a*, while FIG. 6 is a front view thereof. Each wheel of FIGS. 5 and 6 comprises a central circular portion 25 of hard rubber and a pair of outer beveled circular portions 26 of metal fixed to the central circular portion 25. In addition, in conjunction with each pair of the wheels of FIGS. 5 and 6 a short storing means K (of FIGS. 5 and 6) may be provided on a position on the floor F which adjoins the wall W. The storing means K comprises a pair of rails 27 and a bottom portion 28 between the rails 27. When the stage system is stored to the previously second vertical position, the central portion 25 ride on the bottom portion 28 of the storing means K while the outer portions 26 roll on the rails 27.

The construction of FIGS. 5 and 6 allows the stage system to be stored more safely in the vertical position.

FIG. 2 shows the positions where the storing means K are to be located.

What is claimed is:

1. An electrically-operated folding stage system comprising (a) a stage body with
  (i) a platform 1,
  (ii) plural rows of upright legs 4–7 pivotally connected to a bottom J of the platform 1, and
  (iii) plural connecting members 9 each connecting lower portions 31 of the legs 4–7 of one of the leg rows, (b) wheels 12, 12*a* connected to bottoms of foremost legs 4 to facilitate movements of the stage body on a floor F, (c) plural geared motors M fixed to the bottom J of the platform 1 and each capable of being rotated in either of clockwise and counterclockwise directions to move the stage body between a horizontal position P on the floor F and a vertical position X immediately adjacent to a wall W, each of the geared motors M having an output shaft 16, (d) swing arms each having one end 19 fixed to the output shaft 16 of one of the geared motors M, and (e) support means 17 each provided in conjunction with one of the swing arms and located on a given position predetermined in relation to a lower portion of the wall W for pivotally supporting an opposed end 21 of the swing arm, said given position being selected from among a corner G at which the floor F and the wall W meet, a position N on the floor F which is in close proximity to the wall W and a position H on the wall W which is on a lower level than the platform 1 when the platform 1 is in the horizontal position P.

2. A system in accordance with claim 1 wherein the swing arm comprises a pair of integrally formed tubes 18 and a pair of rods 20 slidably disposed in the respective tubes 18.

3. A system in accordance with claim 1 wherein said one end 19 of the swing arm is fixed to the output shaft 16 at a position which is further from a front edge E of the stage body than a straight line extending in parallel with the front edge R of the stage body and connecting one side 32 of the stage body, a center of gravity thereof and an opposed side 33 thereof.

4. An electrically-operated folding stage system comprising (a) a stage body with
  (i) a platform 1,
  (ii) plural rows of upright legs 4–7 pivotally connected to a bottom J of the platform 1, and
  (iii) plural connecting members 9 each connecting lower portions of the legs 4–7 of one row for connecting the legs 4–7 to one another, (b) wheels 12, 12*a* connected to bottoms of foremost legs 4 to facilitate movements of the stage body on a floor F, each of the wheels 12, 12*a* comprising a central circular portion 25 of rubber and a pair of outer beveled circular portions 26 of metal fixed to opposed sides of the central circular portion 25, (c) plural geared motors M fixed to the bottom J of the platform 1 and each capable of being rotated in either of clockwise and counterclockwise directions to move the stage body between a horizontal position P on the floor F and a vertical position X immediately adjacent to a wall W, each of the geared motors M having an output shaft 16, (d) swing arms each having one end 19 fixed to the output shaft 16 of one of the geared motors M, (e) support means 17 each provided in conjunction with one of the swing arms and located on a given position predetermined in relation to a lower portion of the wall for pivotally supporting an opposed end 21 of the swing arm, said given position being selected from among a corner G at which the floor F and the wall W meet, a position N on the floor F which is in close proximity to the wall W and a position H on the wall which is on a lower level than the platform 1 when the platform 1 is in the horizontal position P, and (f) plural storing means K located in positions on the floor F which adjoin the wall W and each adapted to support the wheels 12, 12*a* when the stage body is in the vertical position X.

5. A system in accordance with claim 4 wherein the swing arm comprises a pair of integrally formed tubes 18 and a pair of rods 20 slidably disposed in the respective tubes 18.

6. A system in accordance with claim 4 wherein said one end 19 of the swing arm is fixed to the output shaft 16 at a position which is further from a front edge E of the stage body than a straight line connecting one side 32 of the stage body, a center of gravity thereof and an opposed side 33 thereof.

7. An electrically-operated folding stage system comprising (a) a stage body with
  (i) a platform 1,
  (ii) plural rows of upright legs 4–7 pivotally connected to a bottom J of the platform 1, and
  (iii) plural connecting members 9 each connecting lower portions 31 of the legs 4–7 of one row for connecting the legs 4–7 to one another, (b) wheels 12, 12*a* connected to bottoms of foremost legs 4 to facilitate movements of the stage body on a floor F, (c) plural support means 17*a* fixed to the bottom J of the platform 1, (d) plural operating means M each located on a corner at which the floor F and the wall W meet and capable of being rotated in either of clockwise and counterclockwise directions to move the stage body between a horizontal position P on the floor F and a vertical position X immediately adjacent to a wall W, each of the operating means M having an output shaft 16*a*, and (e) swing arms each having one end 19 fixed to the output shaft 16*a* of one of the operating means M and an opposed end 21 pivotally connected to one of the support means 17*a*.

8. A system in accordance with claim 7 wherein the operating means M are geared motors.

9. A system in accordance with claim 7 wherein the swing arm comprises a pair of integrally formed tubes 18 and a pair of rods 20 slidably disposed in the respective tubes.

10. A system in accordance with claim 7 wherein the pivotal connection of the opposed end 21 of the swing arm to the support means 17*a* is made at a position which is further from a front edge E of the stage body than a straight line extending in parallel with the front edge E of the stage body and connecting one side 32 of the stage body, a center of gravity thereof and an opposed side 33 thereof.

11. An electrically-operated folding stage system comprising (a) a stage body with
  (i) a platform 1,
  (ii) plural rows of upright legs 4–7 pivotally connected to a bottom J of the platform 1, and
  (iii) plural connecting members 9 each connecting lower portion 31 of the legs 4–7 of one row for connecting the legs 4–7 to one another, (b) wheels 12, 12*a* connected to bottoms of foremost legs 4 to facilitate movements of the stage body on a floor F, each of the wheels 12, 12*a* comprising a central circular portion 25 of rubber and a pair of outer beveled circular portions 26 of metal fixed to opposed sides of the central circular portion 25, (c) plural support means 17*a* fixed to the bottom J of the platform 1, (d) plural operating means M each located on a corner at which the floor F and the wall W meet and capable of being rotated in either of clockwise and counterclockwise directions for moving the stage body between a horizontal position P on the floor F and a vertical position X immediately adjacent to a wall W, each of the operating means M having an output shaft 16 *a*, (e) swing arms each having one end 19 fixed to the output shaft 16*a* of one of the operating means M and an opposed end 21 pivotally connected to one of the support means 17*a*, and (f) plural storing means X located in positions on the floor F which adjoin the wall and each adapted to support the wheels 12, 12*a* when the stage body is in the vertical position

12. A system in accordance with claim 11 wherein the operating means M are geared motors.

13. A system in accordance with claim 11 wherein the swing arm comprises a pair of integrally formed tubes 18 and a pair of rods 20 slidably disposed in the respective tubes 18.

14. A system in accordance with claim 11 wherein the pivotal connection of the opposed end 21 of the swing arm to the support means 17*a* is made at a position which is further from a front edge E of the stage body than a straight line extending in parallel with the front edge E of the stage body and connecting one side 32 of the stage body, a center of gravity thereof and an opposed side 33 thereof.

* * * * *